US010362418B2

(12) United States Patent
Bern et al.

(10) Patent No.: US 10,362,418 B2
(45) Date of Patent: Jul. 23, 2019

(54) MOUNTING ASSEMBLY FOR A BONE CONDUCTION HEARING DEVICE

(71) Applicant: OTICON MEDICAL A/S, Smørum (DK)

(72) Inventors: Bengt Bern, Smørum (DK); Hanna Simonsson, Smørum (DK); Martin Johansson, Smørum (DK); Troels Böwadt Arnved, København N. (DK); Martin Thomsen, København N. (DK); Rasmus Funk, København S (DK); Mads Madsen, Greve (DK); Line Topholm Janum, Kongens Lyngby (DK)

(73) Assignee: Oticon Medical A/S, Smørum (DK)

( * ) Notice: Subject to any disclaimer, the term of this patent is extended or adjusted under 35 U.S.C. 154(b) by 0 days.

(21) Appl. No.: 15/700,682

(22) Filed: Sep. 11, 2017

(65) Prior Publication Data

US 2018/0077505 A1 Mar. 15, 2018

(30) Foreign Application Priority Data

Sep. 12, 2016 (EP) ..... 16188317

(51) Int. Cl.
*H04R 25/00* (2006.01)

(52) U.S. Cl.
CPC ..... *H04R 25/606* (2013.01); *H04R 2225/63* (2013.01); *H04R 2460/13* (2013.01)

(58) Field of Classification Search
CPC ..... H04R 2460/13; H04R 25/606; H04R 5/0335; H04R 2225/67; H04R 1/1016; H04R 25/65; H04R 1/1041; H04R 2201/023; H04R 2460/17; H04R 25/554; H04R 25/658; H04R 5/023; H04R 17/00; H04R 1/1033; H04R 2420/07; H04R 25/00; A42B 3/044; A42B 3/08; A42B 3/142; A42B 3/322; A42B 3/324; A42B 1/002; A42B 1/006; A42B 1/041; A42B 1/08; A42B 1/205; A42B 1/22; A42B 3/0453; A42B 3/046; A42B 3/085; A42B 3/147; A42B 3/225; A42B 3/30
USPC ..... 381/380, 370, 378, 381; 600/323, 383, 600/390, 25, 559, 27, 300; 455/344, 100, 455/351, 269
See application file for complete search history.

(56) References Cited

U.S. PATENT DOCUMENTS 4,918,757 A * 4/1990 Janssen ..... H04R 25/02 2/171
2007/0041595 A1* 2/2007 Carazo ..... H04R 17/00 381/151

(Continued)

*Primary Examiner* — Curtis A Kuntz
*Assistant Examiner* — Julie X Dang
(74) *Attorney, Agent, or Firm* — Birch, Stewart, Kolasch & Birch, LLP

(57) ABSTRACT

A mounting assembly for arranging a bone conducting hearing device to a skin surface over the skull of a user is disclosed. The mounting assembly comprises an attachment element configured to be attached to a corresponding vibrator attachment element of a vibrator assembly, the attachment element and the vibrator attachment element being adapted to operationally couple with each other; a plate member configured to be arranged over the skin surface; one or more removably arranged mounting structures arranged outside the skull for attaching the mounting assembly to the skin surface over the skull.

12 Claims, 13 Drawing Sheets

(56) References Cited

U.S. PATENT DOCUMENTS

2007/0071258 A1* 3/2007 Calhoun ..... H04R 5/023
381/151
2013/0089229 A1* 4/2013 Kristo ..... H04R 25/606
381/326

* cited by examiner 8
70
70'
18
72
72'
10
68
56'
74
76
78
124

Fig. 2A
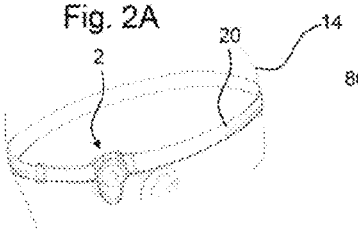
Fig. 2C
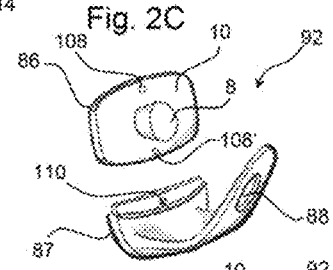
Fig. 2E
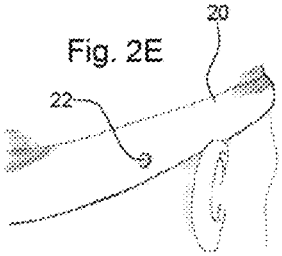
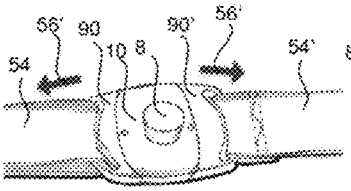
Fig. 2B
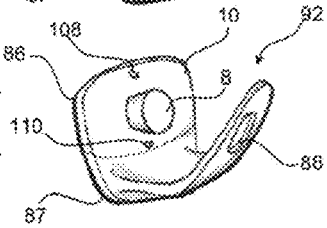
Fig. 2D
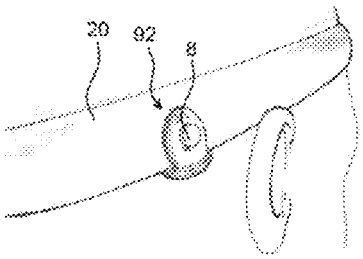
Fig. 2F Fig. 3A
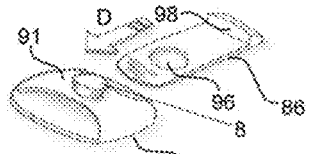
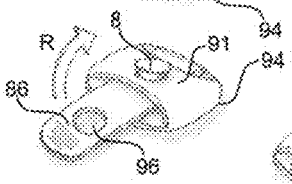
Fig. 3B
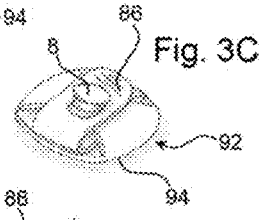
Fig. 3C
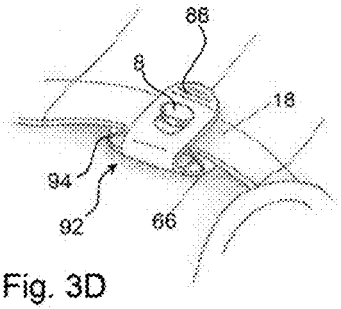
Fig. 3D
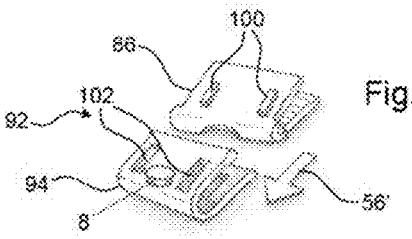
Fig. 3E
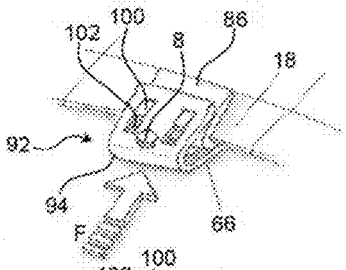
Fig. 3F
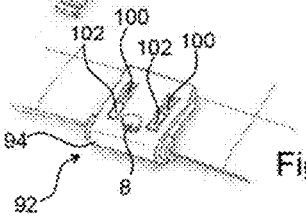
Fig. 3G Fig. 4A
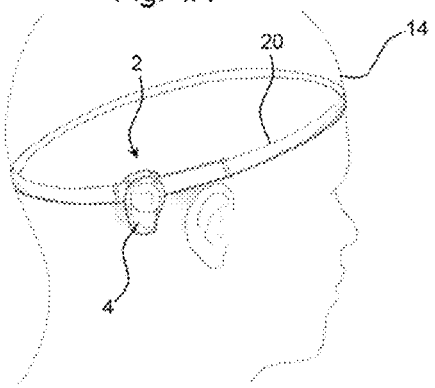
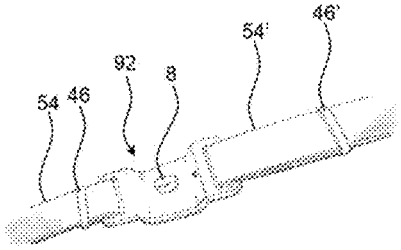
Fig. 4B
Fig. 4C
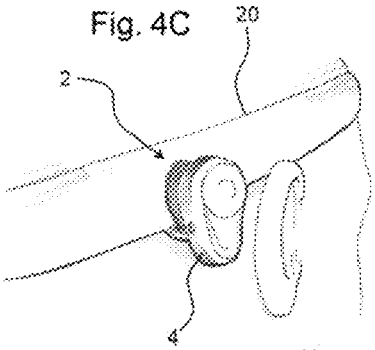
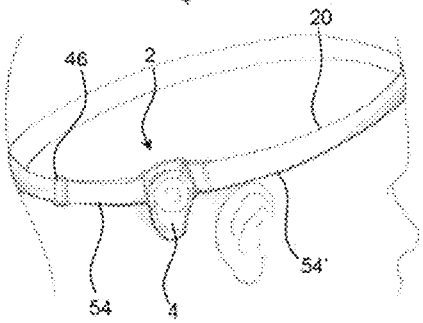
Fig. 4D Fig. 5A
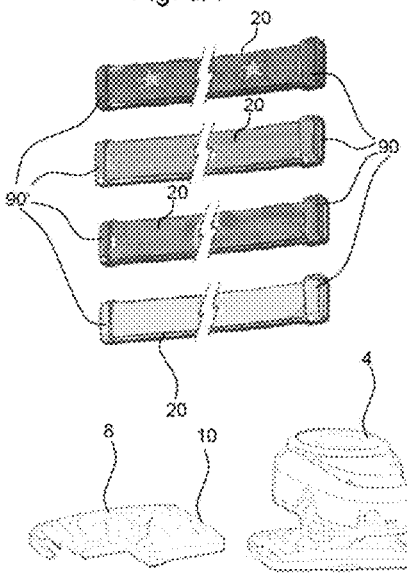
Fig. 5B
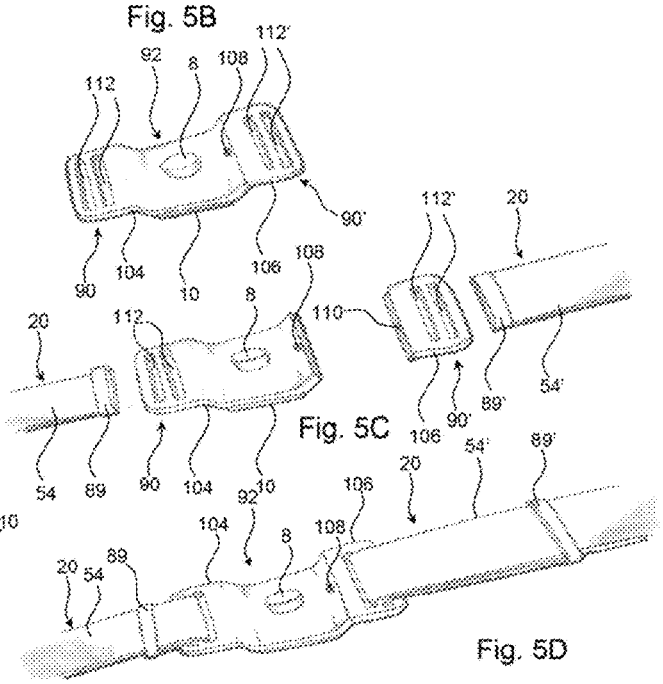
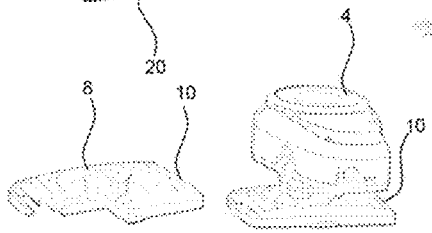
Fig. 5E
Fig. 5D 48
20

20
46
44
46'

20
46
44
46'

18
22
44
8
72
48
80
10

8
18
72
10

Fig. 9A
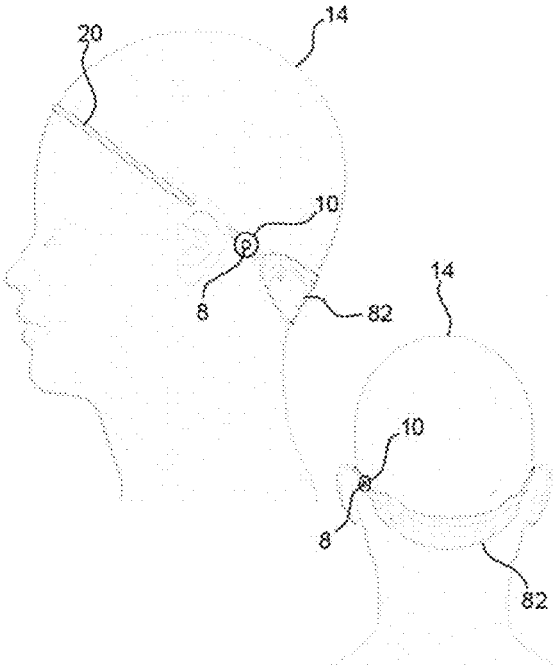
Fig. 9B
Fig. 9C
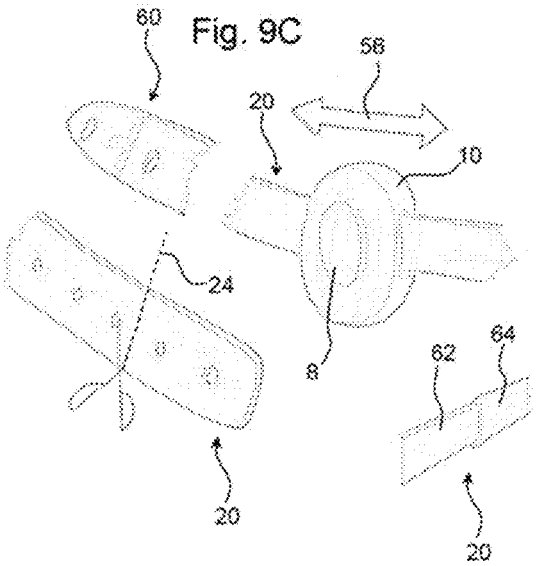

14
20
22
16

20
28
26

20
24
24

28
56'
30
32

4
6
8
20
10

22
10
8
22
20
16

20
10
8

22
10
8
20

Fig. 11A
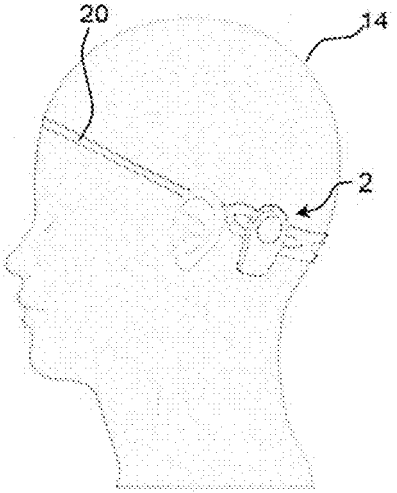
Fig. 11C
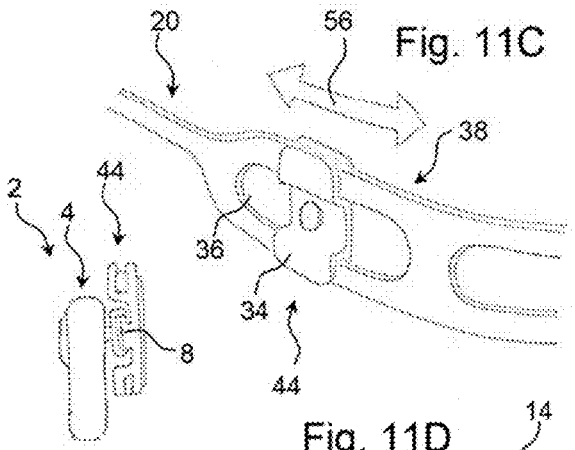
Fig. 11B
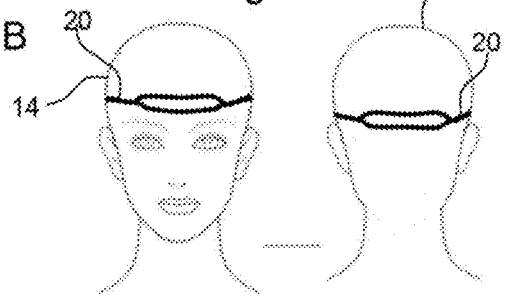
Fig. 11D
Fig. 11E
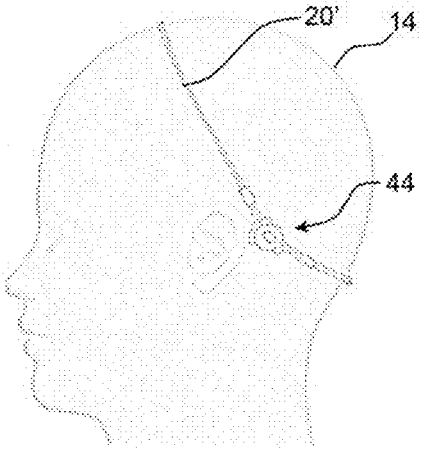
Fig. 11F
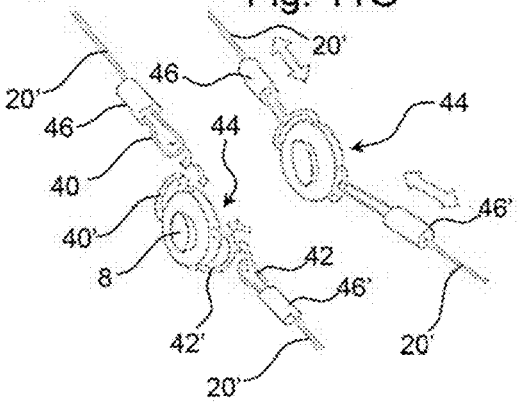
Fig. 11G Fig. 12A
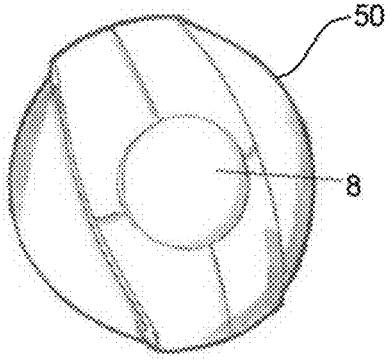
Fig. 12B
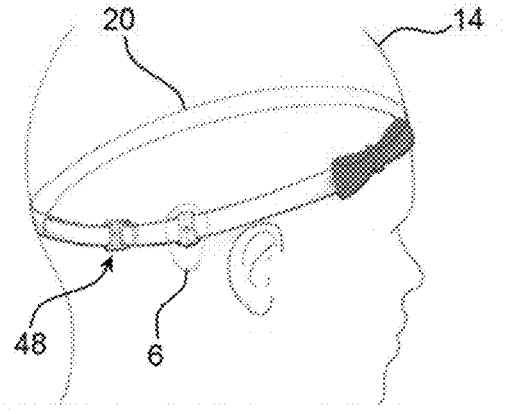
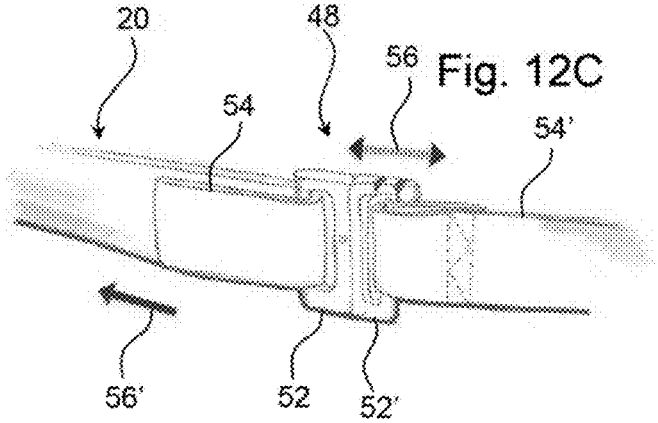
Fig. 12C
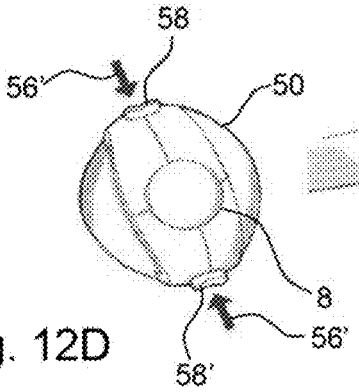
Fig. 12D
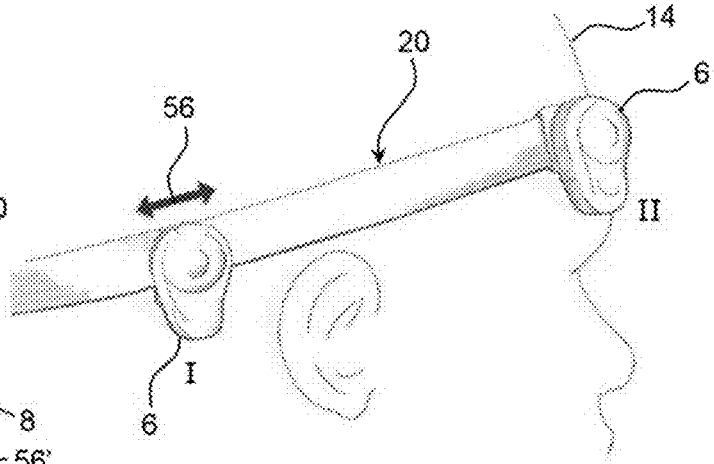
Fig. 12E

MOUNTING ASSEMBLY FOR A BONE CONDUCTION HEARING DEVICE

FIELD

The present disclosure relates to a mounting assembly for a bone conduction hearing device. More particularly, the disclosure relates to a bone conduction hearing aid system that can be worn without having an implantable part.

BACKGROUND

Bone conduction hearing aid systems are based on bone conduction principle where skull bone is used as a medium to transfer sound vibrations to the inner ear. This may generally include people who have problems with either outer ear, middle ear or both.

Bone conduction hearing devices are a significant and important market in the field of hearing devices or hearing aids. There are five major types of bone conduction devices, including: (1) External bone conduction devices where a vibrator is held to the side of the head by a band that traverses around the head (2) Bone anchored hearing devices where a screw is placed through the skin into the skull and a vibrator transducer is hung to the side of the screw (abutment) (3) Magnetic bone conduction hearing implants, where magnets are implanted and attached to the skull and externally positioned magnets provide a normal force to the side of the head to hold the vibrator to the head; (4) Teeth vibrators where the vibrator is attached to a tooth or a dental implant (5) Active implantable bone conduction devices, where a transducer is implanted under the skin to vibrate the skull.

For external bone conduction hearing devices, an important aspect is ensuring the external component is secured to the side of the head without adverse biological effects. Long-term use of headband-worn bone vibrators may cause skin ulceration and, in severe cases, physical depression at the point of contact. Also, reactions around the abutment may range from skin irritation and erythema to an overt infection causing implant extrusion.

There are several known systems for securing a device to the user include such as headband, spectacles, double stick tape. The various devices disclosed in the art, however, have substantial limitations in that they either do not sufficiently and reliably provide adequate force, provide too much force, are obtrusive or uncomfortable, or require implantation with attendant costs and surgical intervention.

Accordingly, there is a need to provide a bone conduction hearing aid system that reduces or even eliminates the drawbacks of the prior art solutions.

There is a need to provide a mounting assembly for a bone conduction hearing aid that is more user-friendly than the prior art solutions.

It may be an advantage to have a mounting assembly that makes it possible for the user of a bone conduction hearing aid to adjust the position of the sound processor and/or the vibrator to the desired location on the head of the user.

SUMMARY

Preferred embodiments of the present disclosure can be achieved by a mounting assembly as defined in claim 1. Other preferred embodiments are defined in the dependent sub claims, explained in the following description and illustrated in the accompanying drawings.

The disclosed mounting assembly reliably and comfortably typically applies a normally-directed contact force against the skull of the user. The assembly avoids problems associated with unreliable force generation, uneven force distribution, or overly obtrusive components, thereby facilitating wearability and durability of the device, including over long periods of use.

According to an aspect of the disclosure, the mounting assembly is a mounting assembly for arranging a bone conducting hearing device to a skin surface over the skull of a user, the mounting assembly comprising:

- an attachment element configured to be attached to a corresponding vibrator attachment element of a vibrator assembly, the attachment element and the vibrator attachment element being adapted to operationally couple with each other;
- a plate member configured to be arranged over the skin surface;
- one or more removably arranged mounting structures arranged outside the skull for attaching the mounting assembly to the skin surface over the skull.

Hereby, it is possible to provide a freely moveable and mountable assembly for a bone conduction hearing aid. The mounting assembly makes it possible for the user to adjust the position of the sound processor and/or the vibrator to the desired location on the head of the user.

The mounting assembly is a mounting assembly for arranging a bone conducting hearing device to a skin surface over the skull of a user. The mounting assembly may utilize the configuration describe and may include a suitable type and size.

By the term "arranging a bone conducting hearing device" is meant that said bone conducting hearing device is positioned, sized and/or oriented in such a manner that so that the bone conducting hearing device is in contact with the skin surface over the skull and ready or use.

The mounting assembly comprises an attachment element such as an abutment configured to be attached to a corresponding vibrator attachment element of a vibrator assembly. Thus, the attachment element and the vibrator attachment element are adapted to operationally couple with each other. The attachment element may have any suitable size, form and configuration enabling it to be attached to the corresponding vibrator attachment element of the vibrator assembly.

The vibrator attachment element of the vibrator assembly may have any suitable size, form and configuration enabling it to be attached to the attachment element.

The plate member may have any suitable size and form as long as it is capable of being arranged over the skin surface and hereby be brought into contact with the skin surface. The plate member may be formed of a hard plastic material.

In an embodiment, the plate member on the skin facing side comprises a comformable material such as silicone in order to provide comfortable wear. The comformable material may include a material that is softer than the material used for the plate member. The comformable material at least partially covers the skin facing side of the plate member. The comformable material may even extend beyond the periphery of the plate material. Additionally or alternatively, the plastic member on the skin facing side is concave shaped in order to conform with the shape of the skull.

The one or more removably arranged mounting structures arranged outside the skull for attaching the mounting assembly to the skin surface over the skull may have any suitable size and geometry enabling the mounting structures allowing the mounting assembly to be attached to the skin surface over the skull.

By the term "arranged outside the skull" is meant that said mounting structures is positioned, sized and/or oriented in such a manner that so that the mounting structures are located outside the skull over a skin surface of the user.

According to another aspect of the disclosure, the plate member comprises a proximal side adapted to face towards the skin surface, and a distal side opposite to the proximal side and comprising an abutment.

Hereby, it is possible to provide a simple and reliable plate member that is suitable for being used to establish skin contact and at the same time is capable of receiving a vibrator assembly configured to be attached to the abutment.

It may be an advantage that the vibrator assembly comprises a speech processor and a vibrator, the vibrator being configured to be attached to the abutment on the distal side of the plate member.

According to an embodiment, the mounting structure includes a double-sided adhesive tape. The double sided adhesive tape includes a first side configured to be attached to skin facing side of the plate member and a second side configured to be attached to the skin over the skull.

According to a further aspect of the disclosure, the plate member comprises an engagement structure and the attachment element comprises an abutment comprising a receiving structure configured to permanently or detachably lock with the engagement structure.

Hereby, it is possible to attach the abutment to the plate member in an easy and reliable manner. Furthermore, the use an engagement structure protruding from the distal side of the plate member allows for an easy and appropriate attachment of the abutment to the plate member.

According to an even further aspect of the disclosure, the abutment is detachably attached to the plate member.

Hereby, it is possible to replace the plate member or the abutment if desired.

The abutment can be detachably attached to the plate member by providing the plate member with an engagement structure and providing the abutment with a receiving structure configured to detachably lock with the engagement structure of the plate member.

According to another aspect of the disclosure, the abutment comprises a bore and the plate member comprises an engagement structure configured to be lockingly received by the bore.

Hereby, it is possible to attach the abutment to the plate member in a simple way, which only requires very few and simple elements. This solution makes it possible to permanently or detachably attach the abutment to the plate member.

According to a further aspect of the disclosure, the abutment comprises a through-going bore and the plate member comprises an engagement structure configured to be lockingly received by the through-going bore.

Hereby, it is possible to access the distal portion of the engagement structure of the plate member through the through-going bore. Accordingly, the distal portion of the engagement structure of the plate member can be processed e.g. during an assembling process in which the distal portion of the engagement structure of the plate member is deformed to permanently or detachably secure the abutment to the engagement structure of the plate member.

According to an even further aspect of the disclosure, the engagement structure of the plate member is a separate unit assembly. The one-piece body may be a screw or another fastening element adapted to be attached to the plate member and to the abutment.

According to another aspect of the disclosure, the bore provided in the abutment comprises an edge for establishing a lockingly engagement with the engagement structure of the plate member. The edge may be shaped as a barb configured to prevent the engagement structure of the plate member to be moved backwards once the engagement structure of the plate member engages the edge. It may be an advantage that the edge is formed as an annular structure protruding radially from the inside surface of the bore. The inside surface of the bore may be cylindrical, conical or have any other suitable geometry.

According to another aspect of the disclosure, the plate member is configured to be positioned at the skin facing side of the mounting structure and the abutment is configured to be positioned at the other side of the mounting structure, wherein the engagement structure extends through an opening in the attachment structure.

According to an embodiment, the mounting structure includes a single-sided adhesive tape comprising a hole. The hole is configured to allow the engagement structure to extend through such that the plate member is configured to be positioned on the skin facing side of the single sided adhesive tape whereas the engagement structure extends through the hole. The engagement structure is adapted to couple with an attachment element such as an abutment is configured to be positioned on the other side of the single sided adhesive tape. The skin facing side includes an adhesive material configured to attach to the skin over skull. The single sided tape typically extends beyond edge of the plate member and is flexible enough so that the tape can be bent around edge of the plate member and attach to the skin surface.

Hereby, it is possible to attach the abutment to the plate member in a simple and reliable manner.

According to a further aspect of the disclosure, the mounting assembly is formed as a kit configured to be used to arrange a bone conducting hearing device onto the skin surface over the skull of a user. Such kit may comprise a plate member and a mounting structure configured to be attached to the plate member and to the vibrator assembly of the bone conducting hearing device. The kit may be applied together with various types of attachment element (e.g. a cap, a sweatband, a chain or any suitable headgear).

According to another aspect of the disclosure, the mounting assembly comprises a bracket member comprising a plate member adapted to contact with the skin surface over the skull, wherein the bracket member comprises structures adapted to be attached to the attachment elements or engagement members adapted for attaching the bracket member to attachment structures and hereby arrange the mounting assembly in contact with the skin surface over the skull.

Hereby, the mounting assembly can be attached to the attachment elements in an easy manner. Moreover, this solution makes it possible to position the mounting assembly and hereby the bone conducting hearing device in any suitable position on the skull of the user.

According to a further aspect of the disclosure, the bracket member comprises a first portion and a second portion adapted to be attached to each other. Hereby, the bracket member can be assembled by joining the first portion and the second portion. The arrangement of a hearing device may be eased by using such segmented bracket member.

According to another aspect of the disclosure, the bracket member has a basically C-shaped or U-shaped profile. A basically C-shaped or U-shaped profile allows for bringing the plate member into contact with the skin surface over the skull and at the same time enables an easy attachment of the mounting assembly to the attachment elements.

According to a further aspect of the disclosure, the bracket member comprises:

an insert structure comprising the plate member or an insert structure configured to receive the plate member.

Hereby, the insert structure can be attached to e.g. a cap, a sweatband, a chain or any suitable headgear. The solution enables the bracket member to be positioned in various positions.

According to another aspect of the disclosure, the bracket member comprises a receiving structure and an insert structure, wherein the receiving structure is configured to receive the insert structure, wherein the receiving structure comprises an abutment.

Hereby, it is possible to achieve a bracket member capable of being attached to various structures including a cap, a sweatband or a suitable headgear in a fast and simple manner.

According to a further aspect of the disclosure, the insert structure is bendable and configured to form an edge along a bend. The insert structure also comprises a hole, through which the abutment can extend when the insert structure is in a bendable configuration, i.e. when the insert structure is bent to form the edge.

Hereby, it is possible to fold the insert structure and hereby detachably attach the bracket member to a structure such as a cap, a sweatband or a headgear in a fast and easy. This solution enables a fast attachment and detachment of the bracket member.

According to a further aspect of the disclosure, the insert structure comprises an end portion configured to brought into contact with a portion of the receiving structure and hereby prevent the insert structure from being further displaced when pulling the insert structure.

Hereby, it is possible to fix the end portion and thus the insert structure to the receiving structure in a simple and reliable manner.

According to another aspect of the disclosure, the receiving structure comprises a through-going opening, through which the insert structure can be inserted.

Hereby, it is possible to attach the receiving structure and the insert structure to each other in an easy manner.

According to a further aspect of the disclosure, the receiving structure comprises a bridge structure extending from one end of the receiving structure to the opposite end of the receiving structure, wherein the through-going opening is provided under the bridge structure.

Hereby, the insert structure can be inserted through the opening extending under the bridge structure. Accordingly, a reliable and simple attachment of the insert structure and the receiving structure can be provided.

According to another aspect of the disclosure, the abutment is arranged centrally on the bridge structure.

Hereby, the attachment of the vibrator assembly to the abutment is eased. Furthermore, the size of the bracket member can be reduced.

According to a further aspect of the disclosure, the insert structure comprises one or more protrusions and the receiving structure comprises one or more corresponding openings configured to receive the protrusion(s), wherein the insert structure is configured to be attached to a mounting structure.

Hereby, the insert structure of the bracket member can be attached to the receiving structure in an easy a simple manner. This solution enables application of a folded receiving structure and optionally a folded insert structure.

According to another aspect of the disclosure, the insert structure and/or the receiving structure comprises a first portion configured to be arranged over the mounting structure and a second portion configured to be arranged under the mounting structure.

Hereby, it is possible to fix the insert structure to mounting structure such as a cap, a sweatband or a suitable headgear in a fast and simple manner.

According to a further aspect of the disclosure, the mounting assembly comprises one or more length adjusting members adapted to adjust the length of the mounting structure and/or the position of the mounting assembly with respect to the mounting structure.

Hereby, it is possible to adjust the length of the mounting structure and/or the position of the mounting assembly with respect to the mounting structure. Accordingly, a correct/desired position of the mounting assembly can be achieved.

According to a further aspect of the disclosure, the mounting assembly comprises a mounting member slidably attached to a mounting portion of the mounting structure.

By having a mounting member slidably attached to a mounting portion of the mounting structure it is possible to change the position of the mounting member relative to the mounting structure in order to arrange/position the mounting member in the most desirable position.

According to another aspect of the disclosure, the mounting assembly comprises a mounting member comprising attachment members adapted to be attached to conesponding attachment members of the mounting structure.

Hereby, it is possible to provide a fast and easy attachment of the mounting structure to the mounting member. The attachment members of the mounting member may protrude from the mounting member. The attachment members of the mounting member may be formed as C-shaped structures configured to receive an eye member configured to be attached to the attachment member.

According to another aspect of the disclosure, the mounting assembly comprises a bracket mount configured to be slidably attached to the mounting structure.

Hereby, it is possible to change the position of the bracket mount and thus the bone conducting hearing device relative to the mounting structure. The bracket mount may be configured to receive a band going through the bracket mount. The bracket mount may be provided with one or more buttons for bringing the bracket mount into a configuration in which the bracket mount can be moved along the band.

According to a further aspect of the disclosure, the bracket mount comprises structures for bringing the bracket mount out of engagement with the mounting structure for moving the bracket mount along the mounting structure.

Hereby, the vibrator assembly of the bone conducting hearing device can be moved freely along the mounting structure (e.g. a band).

According to another aspect of the disclosure, the plate member comprises an adhesive structure configured to be attached to the plate member to the skin surface over the skull of the user.

Hereby, the plate member can be attached to the skin surface over the skull of a user in a fast an easy manner.

According to another aspect of the disclosure, the plate member is at least partly covered in soft material, preferably a soft plastic material.

Hereby, a more comfortable plate member can be achieved. It is possible to provide a plate member comprising a comfortable soft material to contact the skin and adapt to the shape of the skull.

According to a further aspect of the disclosure, the plate member is provided with a core made in a flexible hard material, preferably a plastic material, covered with a softer material, preferably a plastic material that is in contact with the skin.

Hereby, the plate member is capable of transferring mechanical vibrations to the user's inner ears through bone structure of the user's head (skull).

According to a further aspect of the disclosure, the mounting assembly comprises an element configured to allow the mounting element to be displaced relative to an fixing element to which the is attached, wherein the mounting element is configured to receive the vibrator assembly.

Hereby, the position of the mounting element relative to the fixing element can be changed.

According to another aspect of the disclosure, the mounting assembly comprises a locking element configured to attach the vibrator assembly directly or indirectly to a connection structure or a piece of cloth.

According to an embodiment, a bone conduction hearing aid assembly is disclosed. The bone conduction hearing aid assembly includes a bone conduction hearing aid, a mounting structure configured to be worn around a user's head and a mounting assembly as described in this disclosure. The mounting assembly is configured to be attached to the mounting structure and the bone conduction hearing aid is configured to be removably attached to the mounting assembly.

Hereby, the vibrator assembly can be secured directly or indirectly to a connection structure or a piece of cloth.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

FIG. 2A shows a schematic, side view of a hearing device attached to a band fixed to the head of a user by means of one embodiment according to the disclosure;

FIG. 2B shows a schematic view of a bracket member of an embodiment according to the disclosure;

FIG. 2C shows a schematic view of an insert structure of a bracket member of an embodiment according to the disclosure;

FIG. 2D shows a schematic view of a bracket member of an embodiment according to the disclosure;

FIG. 2E shows a schematic view of a band/strap provided with a hole for receiving an abutment of a bracket member of an embodiment according to the disclosure;

FIG. 2F shows a bracket member of an embodiment according to the disclosure attached to the band/strap shown in FIG. 2E;

FIG. 3A shows an insert structure being inserted into a receiving structure of an embodiment according to the disclosure;

FIG. 3B shows the insert structure shown in FIG. 3A received by the receiving structure shown in FIG. 3A;

FIG. 3C shows a bracket member the insert structure shown in FIG. 3A received by the receiving structure shown in FIG. 3A in a configuration in which the insert structure is folded;

FIG. 3D shows the bracket member shown in FIG. 3C attached to a headgear;

FIG. 3E shows a schematic, perspective view of a bracket member of an embodiment according to the disclosure;

FIG. 3F shows the bracket member shown in FIG. 3E being attached to a headgear;

FIG. 3G shows the bracket member shown in FIG. 3F attached to the headgear;

FIG. 4A shows a schematic, side view of a hearing device comprising a vibrator attached to a band fixed to the head of a user by means of one embodiment according to the disclosure;

FIG. 4B shows a schematic view of a bracket member of an embodiment according to the disclosure;

FIG. 4C shows a close-up view of the hearing device shown in FIG. 4A attached to a band fixed to the head of a user;

FIG. 4D shows a schematic, side view of a hearing device comprising a vibrator attached to a band provided with a length adjusting member;

FIG. 5A shows a schematic, side view of four bands configured to be fixed to the head of a user by means of a bracket member of an embodiment according to the disclosure;

FIG. 5B shows a schematic, perspective view of a bracket member according to an embodiment of the disclosure;

FIG. 5C shows a schematic, perspective view of a segmented bracket according to an embodiment of the disclosure;

FIG. 5D shows a schematic, perspective view of the bracket member shown in FIG. 5C attached to a band;

FIG. 5E shows a schematic, perspective view of a plate member and a vibrator according to an embodiment of the disclosure;

FIG. 9A shows a schematic, side view of a user wearing a plate member according to a mounting assembly of an embodiment of the disclosure attached to band;

FIG. 9B shows a schematic, rear view of a user wearing a plate member shown in FIG. 9A;

FIG. 9C shows schematic, close-up views of a plate member and a band according to a mounting assembly of an embodiment of the disclosure;

FIG. 11A shows a schematic, side view of a hearing device attached to a band fixed to the head of a user by means of a mounting assembly of an embodiment according to the disclosure;

FIG. 11B shows a schematic, side view of a vibrator attached to a band by means of a mounting assembly of an embodiment of the disclosure;

FIG. 11C shows a schematic, close-up, perspective view of a band provided with the mounting assembly shown in FIG. 11B;

FIG. 11D shows a user wearing the band shown in FIG. 11A in two different configurations;

FIG. 11E shows a schematic, side view of a mounting assembly attached to a band fixed to the head of a user;

FIG. 11F shows a schematic, close-up, perspective view of a mounting assembly according to an embodiment of the disclosure being attached to a string;

FIG. 11G shows a schematic, close-up, perspective view of a mounting assembly shown in FIG. 11F attached to the string;

FIG. 12A shows a schematic, close-up view of a bracket mount of a mounting assembly according to an embodiment of the disclosure;

FIG. 12B shows a schematic, side view of a vibrator attached to a band positioned over a user's head by means of a mounting assembly of an embodiment according to the disclosure;

FIG. 12C shows a schematic, side view of an attachment structure according to an embodiment of the disclosure;

FIG. 12D shows a schematic view of a bracket mount of a mounting assembly according to an embodiment of the disclosure;

FIG. 12E shows a schematic view of the bracket mount shown in FIG. 12D attached to a band;

DETAILED DESCRIPTION

Figures 1A, 1B, 1C, 1D, 1E, 1F:
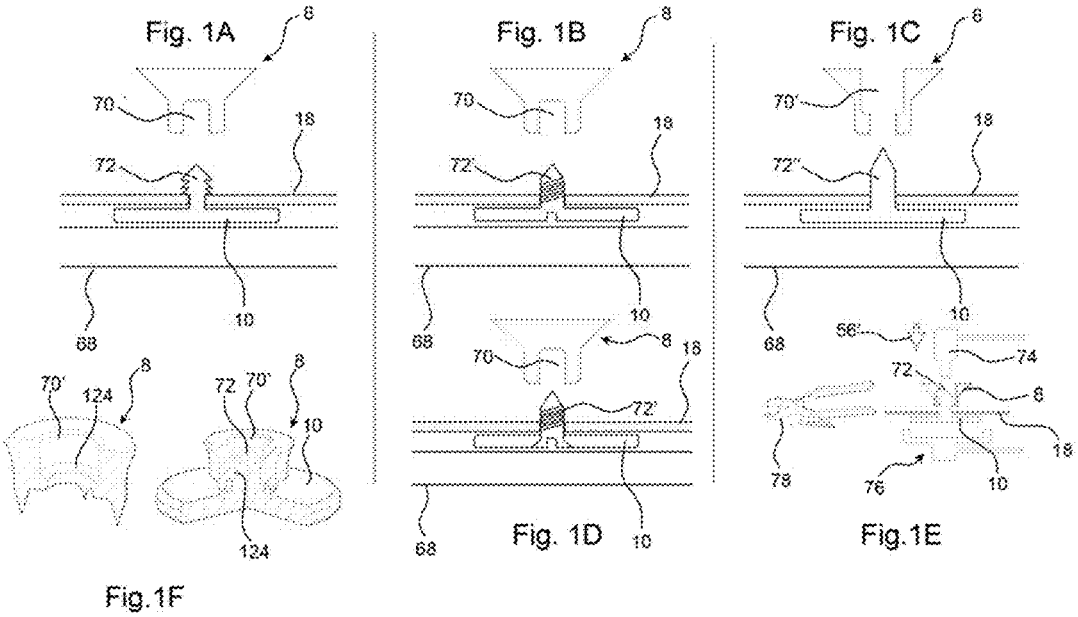
FIG. 1A shows a schematic, cross-sectional view of an abutment being attached to a plate member according to an embodiment of the disclosure, whereby the plate member is fixed to a fixing element such as a band or a cap.
FIG. 1B shows a schematic, cross-sectional view of another abutment being attached to a plate member according to an embodiment of the disclosure in order to attach the plate member to a fixing element such as a band or a cap.
FIG. 1C shows a schematic, cross-sectional view of an abutment being attached to a plate member according to an embodiment of the disclosure in order to attach the plate member to a fixing element such as a band or a cap.
FIG. 1D shows a schematic, cross-sectional view of another abutment being attached to a plate member according to an embodiment of the disclosure in order to attach the plate member to a fixing element such as a band or a cap, wherein a separate engagement structure is applied for the attachment.
FIG. 1E shows a schematic, cross-sectional view of a further abutment being attached to a plate member by means of tools in order to attach the plate member to a fixing element such as a band or a cap.
FIG. 1F shows a schematic, perspective, cross-sectional view of an abutment and a plate member according to an embodiment of the disclosure.

The detailed description set forth below in connection with the appended drawings is intended as a description of various configurations. The detailed description includes specific details for the purpose of providing a thorough understanding of various concepts. However, it will be apparent to those skilled in the art that these concepts may be practiced without these specific details.

A hearing device may include a hearing aid that is adapted to improve or augment the hearing capability of a user by receiving an acoustic signal from a user's surroundings, generating a corresponding audio signal, possibly modifying the audio signal and providing the possibly modified audio signal as an audible signal to at least one of the user's ears. The "hearing device" may further refer to a device adapted to receive an audio signal electronically, possibly modifying the audio signal and providing the possibly modified audio signals as an audible signal to at least one of the user's ears. Such audible signals may be provided in the form of an acoustic signal transferred as mechanical vibrations to the user's inner ears through bone structure of the user's head.

A "hearing system" refers to a system comprising one or two hearing devices, and a "binaural hearing system" refers to a system comprising two hearing devices where the devices are adapted to cooperatively provide audible signals to both of the user's ears. The hearing system or binaural hearing system may further include auxiliary device(s) that communicates with at least one hearing device, the auxiliary device affecting the operation of the hearing devices and/or benefitting from the functioning of the hearing devices. A wired or wireless communication link between the at least one hearing device and the auxiliary device is established that allows for exchanging information (e.g. control and status signals, possibly audio signals) between the at least one hearing device and the auxiliary device. Such auxiliary devices may include at least one of remote controls, remote microphones, audio gateway devices, mobile phones, public-address systems, car audio systems or music players or a combination thereof. The audio gateway is adapted to receive a multitude of audio signals such as from an entertainment device like a TV or a music player, a telephone apparatus like a mobile telephone or a computer, a PC. The audio gateway is further adapted to select and/or combine an appropriate one of the received audio signals (or combination of signals) for transmission to the at least one hearing device. The remote control is adapted to control functionality and operation of the at least one hearing devices. The function of the remote control may be implemented in a SmartPhone or other electronic device, the SmartPhone/electronic device possibly running an application that controls functionality of the at least one hearing device.

In general, a hearing device includes i) an input unit such as a microphone for receiving an acoustic signal from a user's surroundings and providing a corresponding input audio signal, and/or ii) a receiving unit for electronically receiving an input audio signal. The hearing device further includes a signal processing unit for processing the input audio signal and an output unit for providing an audible signal to the user in dependence on the processed audio signal.

The input unit may include multiple input microphones, e.g. for providing direction-dependent audio signal processing. Such directional microphone system is adapted to enhance a target acoustic source among a multitude of acoustic sources in the user's environment. In one aspect, the directional system is adapted to detect (such as adaptively detect) from which direction a particular part of the microphone signal originates. This may be achieved by using conventionally known methods. The signal processing unit may include amplifier that is adapted to apply a frequency dependent gain to the input audio signal. The signal processing unit may further be adapted to provide other relevant functionality such as compression, noise reduction, etc. The output unit may include an output transducer such as a vibrator for providing an vibrations transcutaneously to the skull bone.

Now referring to FIG. 1A, which illustrates a schematic, cross-sectional view of an abutment 8 being attached to a plate member 10 according to an embodiment of the disclosure. The abutment 8 is provided with a bore 70 comprising cavities for receiving the barbed engagement structure 72 such as ribs of the plate member 10. The plate member 10 comprises a plate portion arranged between a fixing element 18 and the skin 68. Accordingly, the plate member 10 can be arranged on the head of a user in a manner in which the plate member 10 is brought into contact with the skin 68. When a vibrator assembly of a bone conduction hearing device (not shown) is attached to the abutment 8, the vibrator assembly can transmit vibrations through user skin through bone such as skull bone to the inner ear via the abutment 8 and the plate member 10. The fixing element 18 may be a band, a cap or another headgear.

The plate member 10 and the engagement structure 72 are illustrated as integrated one piece unit. However, in another implementation, the plate member 10 and the engagement structure 72 may be separate units.

FIG. 1B illustrates a schematic, cross-sectional view of another abutment 8 being attached to a plate member 10 according to an embodiment of the disclosure in order to attach the plate member 10 to a fixing element 18 such as a band or a cap. The plate member 10 comprises an engagement structure 72' protruding from the central part of the plate portion of the plate member 10. The engagement structure 72' comprises a threads that are configured to be detachably fixed to threads provided at inner surface of the bore of the abutment 8 by screwing the bore 70 provided centrally in the abutment 8 with the engagement structure 72'. The engagement structure 72' may be provided with surface structuring increasing the friction between the engagement structure 72' and the bore 70

The plate member 10 comprises a plate portion that is sandwiched between a fixing element 18 (a band, a cap or another headgear) and the skin 68. Therefore, the plate member 10 can be arranged on the head of a user in a manner in which the plate member 10 is brought into contact with the skin 68. When attaching a vibrator assembly of a bone conduction hearing device to the abutment 8, the vibrator assembly is capable of transmitting sound by transmitting vibrations through the skin to through the bone such as skull bone to the inner ear via the abutment 8 and the plate member 10.

The plate member 10 and the engagement structure 72' are illustrated as integrated one piece unit. However, in another implementation, the plate member 10 and the engagement structure 72' may be separate units as illustrated in FIG. 1D.

FIG. 1C illustrates a schematic, cross-sectional view of an abutment 8 being attached to a plate member 10 according to an embodiment of the disclosure in order to attach the plate member 10 to a fixing element 18 such as a band or a cap.

The abutment 8 is provided with a through-going bore 70' comprising an inward extending portion configured to receive an engagement structure 72" comprising a outward extending portion that is configured to snap lock with the inward extending portion. The engagement structure 72" protrudes from the central part of the plate portion of the plate member 10.

The plate member 10 is provided with a plate portion being sandwiched between a fixing element 18 (a band, a cap or another headgear) and the skin 68. Accordingly, the plate member 10 is configured to be brought into contact with the skin 68 when attached to the fixing element 18. Therefore, a vibrator assembly (not shown) attached to the abutment will be capable of transmitting vibrations across skin through through the bone such as skull bone to the inner ear via the abutment 8 and the plate member 10.

The plate member 10 and the engagement structure 72" are illustrated as integrated one piece unit. However, in another implementation, the plate member 10 and the engagement structure 72" may be separate units.

FIG. 1D illustrates a schematic, cross-sectional view of another abutment 8 being attached to a plate member 10 according to an embodiment of the disclosure in order to attach the plate member 10 to a fixing element 18 such as a band or a cap, wherein a separate engagement structure 72' is applied for the attachment.

The separate engagement structure 72' is shaped as a screw-like structure configured to be engagely received by a bore 70 centrally provided in the abutment 8. The engagement structure 72' includes threads and the bore includes matching threads such that the threads and the matching threads are screwed with respect to each other to provide the engagement between the plate 10 and the abutment 8. An engagement structure (a slot) is provided in the proximal end of the engagement structure 72' for engagement with a screwdriver or another suitable tool (not shown).

The plate member 10 has a plate portion sandwiched between a fixing element 18 (a band, a cap or another headgear) and the skin 68. Therefore, the plate member 10 can be brought into contact with the skin 68 when attached to the fixing element 18. Accordingly, a vibrator assembly (not shown) attached to the abutment can transmit sound by direct conduction through the bone to the inner ear via the abutment 8 and the plate member 10.

The plate member 10 and the engagement structure 72 are illustrated as detachable units. However, in another implementation, the plate member 10 and the engagement structure 72 may be an integrated unit as illustrated in FIG. 1B.

FIG. 1E illustrates a schematic, cross-sectional view of a further abutment 8 being permanently attached to a plate member 10 by means of tools 74, 76, 78 in order to attach the plate member 10 to a fixing element 18 such as a band, a cap or another headgear.

The plate member 10 comprises a centrally arranged engagement structure 72 protruding from the plate portion of the plate member 10. The engagement structure 72 comprises a rounded and enlarged head portion. The enlarged head portion is configured to be axially deformed under force and hereby be radially expanded in order to permanently fix the engagement structure 72 and thus the plate member to the abutment 8. The abutment 8 is provided with a through-going bore comprising an inward extending portion through which the engagement structure 72 has been inserted.

In order to establish the coupling, one tool 76 is arranged and configured to support the plate portion of the plate member 10 during the fixing process. Another tool 74 or 78 may be used deform the enlarged head portion of the engagement structure 72.

The plate member 10 and the engagement structure 72 are illustrated as integral unit. However, in another implementation, the plate member 10 and the engagement structure 72 may be separate units.

FIG. 1F illustrates a schematic, perspective, cross-sectional view of an abutment 8 and a plate member 10 according to an embodiment of the disclosure. It can be seen that the abutment 8 comprises a through-going bore 70' and an edge 124 (inward extending portion) extending radially as an annular structure protruding from the inside surface of the bore 70'. At the left side of FIG. 1F a cut abutment 8 is shown, whereas a plate member 10 attached to the abutment 8 is shown in the right side of FIG. 1F. In the right side of FIG. 1F the centrally arranged engagement structure 72 protruding from the plate portion of the plate member 10 has been inserted through the bore 70' and has been lockingly received by the edge 124. Accordingly, the abutment 8 is firmly attached to the plate member 10.

FIG. 2A illustrates a schematic, side view of a hearing device 2 attached to a band 20 fixed to the skull 14 of a user by means of a mounting member according to the disclosure. It can be seen that the position of the hearing device 2 comprising a vibration assembly can be changed by placing the band 20 differently or by rotating the band 20 about the skull 14 of the user.

FIG. 2B illustrates a schematic view of a bracket member 92' of an embodiment according to the disclosure. The bracket member 92' comprises a plate member 10 comprising an abutment 8, usually provided centrally at the bracket member, adapted to be attached to a vibration assembly (not shown) of a bone conduction hearing device. The abutment 8 protrudes from the plate member 10.

The bracket member 92' further comprises a first attachment structure 90 attached to a first side of the plate member 10 and a second attachment structure 90' attached to a second side of the plate member 10. Each of the attachment structures 90, 90' are provided with an elongated through-going opening adapted to receive the end portion 54, 54' of a band. The position of the bracket member 92' may be adjusted by pulling in one of the lengthwise directions indicated by the arrows 56, 56'. The length of the band may be adjusted e.g. to fit the adjusted position of the bracket member 92'.

FIG. 2C illustrates a schematic view of an insert structure 86 of a bracket member 92 of an embodiment according to the disclosure. The insert structure 86 comprises a plate member 10 provided with an abutment 8, usually provided at the central part of the plate portion, protruding from the plate portion of the plate member 10. The insert structure 86 is provided with at least one engagement member 108, 108' provided on one side of the abutment 8, the engagement member 108 being configured to engage with a corresponding engagement member 110. The engagement member 110 is configured to be received in a slit of the insert structure, the slit comprising the at least one engagement member 108, 108'. The at least engagement member 108, 108' are formed as holes, whereas the corresponding engagement member 110 is formed as a male portion protruding from a plate portion of a receiving element 87 that is configured to be received in the slit.

The receiving element 87 is provided with a hole 88 for receiving the abutment 8 (as shown in FIG. 2D). The receiving element 87 is shaped to receive the insert structure 86 and be attached to the receiving element 87. The periphery of the hole is such that the hole is configured to substantially abut the circumference of the abutment. This may be implemented by having the hole periphery that is configured to expand to allow receiving of the abutment. Additionally, the periphery of the hole 96 may be configured to provide a friction fit between the abutment and the periphery.

The bracket member thus includes insert structure 86 and the receiving element 87 that are configured to couple with each other. In the coupled state (as shown in FIG. 2D, the bracket member forms a generally U-shaped structure. The generally U-shaped structure is configured to fold at a base of the generally U-shaped structure and allowing receiving of the abutment 8 in the hole 88.

FIG. 2D illustrates a schematic view of a bracket member 92 of an embodiment according to the disclosure. The bracket member 92 corresponds to the one shown in FIG. 2C, however, in the illustrated figure the receiving element 87 and the insert structure 86 have been attached to each other.

FIG. 2E illustrates a schematic view of a band/strap 20 provided with a hole 22 for receiving an abutment of a bracket member of an embodiment according to the disclosure. A hearing aid user is wearing the band/strap 20.

FIG. 2F illustrates a bracket member 92 of an embodiment according to the disclosure attached to the band/strap 20 shown in FIG. 2E. The bracket member 92 corresponds to the one shown in FIG. 2C and FIG. 2D.

The insert structure 86 of the generally U-shaped structure (see FIG. 2D) is configured to be positioned on the skin side of the band/strap 20 with the abutment 8 configured to pass through the hole 22. The receiving element 87 is configured to be positioned on the opposite side of the band/strap 20, i.e. side opposite to the skin side. The receiving element 87 is foldable at the base of the generally U-shaped structure and allowing receiving of the abutment 8 in the hole 88.

FIG. 3A illustrates an insert structure 86 being inserted into a receiving structure 94 of an embodiment according to the disclosure. The insert structure 86 comprises a flat portion provided with a hole 96 and an end portion 98 protruding from the flat portion. The insert structure 86 is moved towards a receiving structure 94, as illustrated by direction D.

The receiving structure 94 is provided with a bridge structure 91 extending from one end of the receiving structure 94 to the opposite end of the receiving structure 94 and an abutment 8 protruding from the central portion of the bridge structure 91. A through-going opening configured to receive the flat portion of the insert structure is provided between the bridge structure 91 and an inner face of the receiving structure 94.

FIG. 3B illustrates the insert structure 86 shown in FIG. 3A received by the receiving structure 94 shown in FIG. 3A. When the insert structure 86 is in received in the through-going hole, the end portion 98 is configured to abut against an edge of the receiving structure. This ensure that the insert structure 86 remains attached to the receiving structure 94 when inserted through the opening under the bridge structure 91. An extended section of the insert structure 86 may configured to extend beyond the receiving structure and fold such that the abutment 8 is receivable in the hole 96, as illustrated in FIG. 3C.

As illustrated, the insert structure 86 is bendable and configured to form an edge along a bend, the insert structure 86 comprises a hole 96 through which the abutment 8 is configured to extend when the insert structure 86 is bent to form the edge.

FIG. 3C illustrates the bracket member 92 shown in FIG. 3A received by the receiving structure 94 shown in FIG. 3A in a configuration in which the insert structure is folded. This is achieved because the extended section of the insert structure 86 extending beyond the receiving structure is configured to fold such that the abutment 8 is receivable in the hole 96. The periphery of the hole 96 is such that the hole is configured to substantially abut the circumference of the abutment. This may be implemented by having the hole periphery that is configured to expand to allow receiving of the abutment. Additionally, the periphery of the hole 96 may be configured to provide a friction fit between the abutment and the periphery.

FIG. 3D illustrates the bracket member 92 shown in FIG. 3C attached to a headgear 18. It can be seen that the bracket member 92 is attached to the headgear 18. The headgear 18 includes a hole through with the abutment 8 extends. The receiving structure 94 is configured to be positioned on one side of the headgear with the abutment 8 extendable through the hole of the headgear. The extended section of the flat portion is configured to fold over to opposite side of the head gear such that the abutment 8 is receivable in the hole 96. 66 denotes the skin facing side of the receiving structure 94 of the bracket member 92. 66 is brought into skin contact and when a vibrator assembly (not shown) is attached to the abutment 8, the vibrator assembly can transmit vibrations to the skin and through the bone to the inner ear via the abutment 8 and the bracket member 92.

FIG. 3E illustrates a schematic, perspective view of a bracket member 92 of an embodiment according to the disclosure. The bracket member 92 comprises a folded structure comprising a double-layered insert structure 86 comprising a first layer connected at an edge with a second layer. The insert structure 86 is provided with at least one such as two outward protrusions 100 at a surface of the insert structure 86. The insert structure 86 comprises an arced portion (adjacent to the edge) that may be configured to bear against the abutment 8 of the receiving structure 94.

The bracket member 92 comprises a receiving structure 94 formed as a folded structure provided with at least one such as two openings 102 adapted to engagingly receive the at least one such as two protrusions 100 of the insert structure 86. The folded structure includes a first structure and a second structure, with the first structure comprising the abutment. An abutment 8 protrudes from the receiving structure 94. An arrow 56' indicates the direction at which the insert structure 86 is moved in order to assemble the bracket member 92.

When in position, the first structure abuts the first layer and the second layer abuts the second layer. In an embodiment, the outward protrusions are provided on skin facing layer (second layer) and the openings are provided at skin facing (second) structure. In this particular implementation, the dimensions of outward protrusion is such that when the outward protrusion and the opening are engaged, the protrusion is flush with skin facing surface of the skin facing structure. Additionally or alternatively, the outward protrusions and openings are provided on the first layer and first structure respectively.

In one embodiment, the at least one protrusion may configured to be pressed from an original state and return to the original state. This may be employed by utilizing a flexible material for the outward protrusions or a spring mechanism. In other embodiment, at least one of the receiving structure 94 or insert structure 86 are configured to flex when the insert member 86 is moved along the direction 56' in the receiving structure 94 such that the at least one outward protrusion 100 is received in the at least one opening 102.

FIG. 3F illustrates the bracket member 92 shown in FIG. 3E being attached to a headgear 18. It can be seen that the at least one such as two protrusions 100 provided at the surface of the insert structure 86 have been engagingly received by the openings 102 provided in the receiving structure 94 of the bracket member 92. A portion of the headgear 18 is sandwiched between the two layers of the folded insert structure 86 and the receiving structure 94 is being pushed towards the insert structure 86 by providing a force F as indicated. Hereby, the receiving structure 94 will receive the insert structure 86 and these two structures 86, 94 will be attached to each other as illustrated in FIG. 3G.

FIG. 3G illustrates the bracket member 92 shown in FIG. 3F attached to the headgear 18. The at least one such as two protrusions 100 provided at the surface of the insert structure 86 are inserted into the openings 102 provided in the receiving structure 94 of the bracket member 92. When a vibrator assembly (not shown) is attached to the abutment 8, the a vibrator assembly transmits vibrations to the skin through the bone to the inner ear via the abutment 8 and the bracket member 92.

FIG. 4A illustrates a schematic, side view of a hearing device 2 comprising a vibrator 4 attached to a band 20 fixed to the skull 14 of a user by means of one embodiment according to the disclosure. The speech processor is contained within a housing that may include a vibrator as well. The housing is detachably attached to the abutment.

FIG. 4B illustrates a schematic view of a bracket member 92 of an embodiment according to the disclosure. The bracket member 92 comprises a flat portion provided with an abutment 8 protruding therefrom. At each side of the flat portion a side portion provided with two parallel elongated openings is provided. The end portion 54, 54' of a band is attached to each of the two side portion of the bracket member 92. The band is provided with length adjusting members 46, 46' for adjusting the length of the band in order to make it fit to the user. The bracket member may be configured such that the flat portion comprising the abutment and the flat portion comprising the elongated openings are at different plane. Advantageously, the flat portion comprising the abutment is configured such that at least a partial length of the abutment overlaps with a depth defined between a surface of the flat portion comprising the abutment and surface of flat portion, on same side of abutment, comprising the elongated openings.

FIG. 4C illustrates a close-up view of the hearing device 2 shown in FIG. 4A attached to a band 20 fixed to the head of a user. The vibrator assembly of the hearing device 2 attached to the abutment enables the vibrator assembly to transmit vibrations to the skin and through the bone to the inner ear of the user via the abutment and the mounting assembly of the embodiment of the disclosure.

FIG. 4D illustrates a schematic, side view of a hearing device 2 comprising a vibrator 4 attached to a band 20 provided with a length adjusting member 46 configured to adjust the length of the band 20. The end portions 54, 54' of the band 20 are attached to opposite side portions of the of the bracket member by means of which the hearing device 2 is attached to the band 20. Accordingly, the position of the hearing device 2 can changed in order to position the hearing device 2 in the most desirable/suitable position.

The hearing device 2 comprises a vibrator assembly configured to transmit vibrations to the skin through the bone to the inner ear of the user.

FIG. 5A illustrates a schematic, side view of four bands 20 configured to be fixed to the head of a user by means of a bracket member of an embodiment according to the disclosure. The bands comprise a first attachment structure 90 provided at the right end portion of the bands 20. The bands also comprise a second attachment structure 90' provided at the left end portion of the bands 20. The bands may include different colors and/or designs and/or patterns and/or textures.

FIG. 5B illustrates a schematic, perspective view of a bracket member 92 according to an embodiment of the disclosure. The bracket member 92 comprises a flat portion, usually centrally located, provided with an abutment 8 protruding therefrom. The bracket member 92 comprises a first side portion 104 and a preferably detachable second side portion 106, each provided with attachment structures 90, 90' comprising two securing members 112, 112' formed as parallel elongated openings. The first side portion 104 may include an engagement member 108 configured to engage with a corresponding engagement member 110 of the second side portion 106. The second side portion 106 may thus be detachably attached to the remaining part of the bracket member 92.

The second side portion 106 may include an elongated part comprising the corresponding engagement member 110, the elongated part is configured to be detachably received in a slit provided at a side proximal to and containing the engagement member 108. The engagement member 108 and the corresponding engagement member 110 may include a male-female combination. The engagement between the engagement member 108 and corresponding engagement 110 may be detachable when a pulling force beyond a threshold is applied. This is a useful safety feature.

FIG. 5C illustrates a schematic, perspective view of a segmented bracket 92 according to an embodiment of the disclosure. The bracket 92 corresponds to the one shown in FIG. 5B, however, the second side portion 106 has been removed from the remaining part of the bracket member 92.

The end portions 54, 54' of a band 20 are arranged next to the bracket member 92. Each end portions 54, 54' are insertable into the securing members 112, 112' of the adjacent portion of the bracket member 92. The length of the band may be adjusted in accordance with the requirement of the user and the structure 89, 89' provided at the band may be used to retain the band that is inserted into the securing members.

FIG. 5D illustrates a schematic, perspective view of the bracket member 92 shown in FIG. 5C attached to a band 20.

FIG. 5E illustrates a schematic, perspective view of a plate member 10 and a speech processor 4 contained in a housing, which may also include the vibrator, according to an embodiment of the disclosure. The plate member 10 is provided with a centrally arranged abutment 8 protruding therefrom. At the left side of FIG. 5E the plate member 10 is shown without a vibrator 4 attached thereto. At the right side of FIG. 5E the plate member 10 is shown with a vibrator 4 attached thereto.

Figures 6A, 6B, 6C, 6D, 6E, 6F:
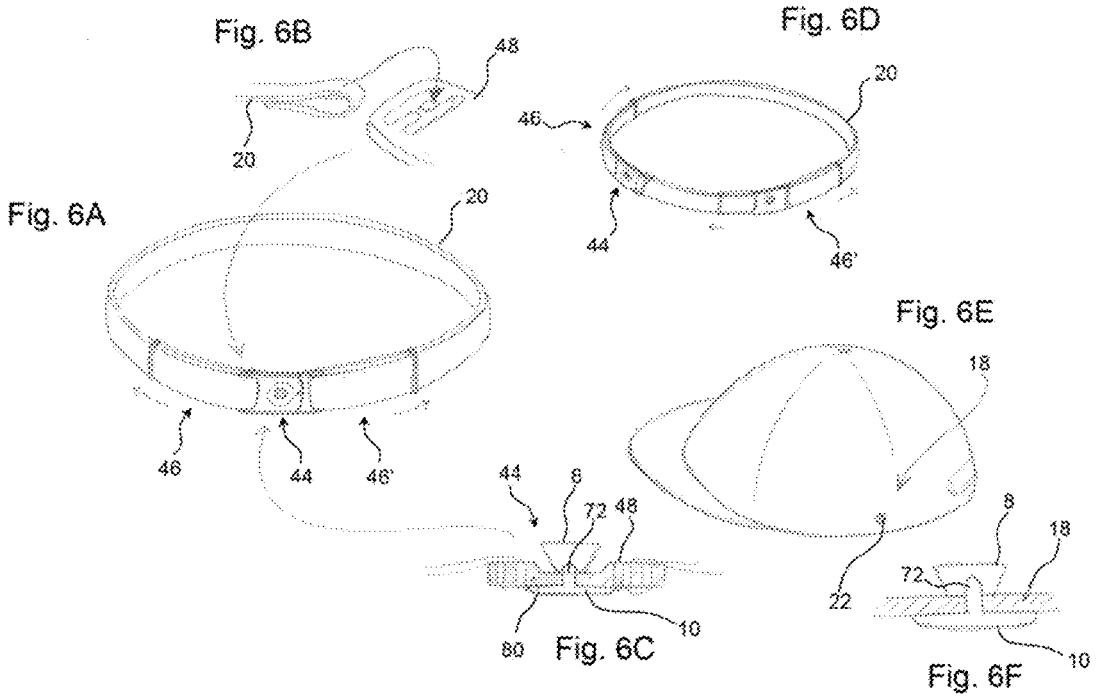
FIG. 6A shows a schematic, perspective view of a band provided with a mounting member according to an embodiment of the disclosure.
FIG. 6B shows a close-up view of the band shown in FIG. 6A being attached to an attachment structure according to an embodiment of the disclosure.
FIG. 6C shows a close-up view of the mounting member shown in FIG. 6A.
FIG. 6D shows a schematic, perspective view of another band provided with a mounting member according to an embodiment of the disclosure.
FIG. 6E shows a headgear provided with an opening for receiving an engagement structure of the mounting member shown in FIG. 6C and FIG. 6F.
FIG. 6F shows a close-up view of a mounting member according to an embodiment of the disclosure attached to a structure of a headgear through an opening for receiving an engagement structure of the mounting member.

FIG. 6A illustrates a schematic, perspective view of a band 20 provided with a mounting member 44 according to an embodiment of the disclosure. The band 20 comprises two length adjusting members 46, 46' provided at each side of the mounting member 44.

The mounting member 44 is configured to receive a hearing device comprising a vibrator assembly configured to transmit sound by direct conduction through the bone to the inner ear of the user.

FIG. 6B illustrates a close-up view of the band 20 shown in FIG. 6A being attached to an attachment structure 48 according to an embodiment of the disclosure. The attachment structure 48 comprises two slots configured to receive the end portion of the band 20.

FIG. 6C illustrates a close-up view of the mounting member 44 shown in FIG. 6A. The mounting member 44 comprises a mounting structure 80 and a plate member 10 provided with an engagement structure 72 attached to an abutment 8. The mounting structure 80 is provided with openings as shown in FIG. 6B.

FIG. 6D illustrates a schematic, perspective view of another band 20 provided with a mounting member 44 according to an embodiment of the disclosure. The band 20 comprises two length adjusting members 46, 46' for adjusting the length of the band 20. The band 20 comprises a mounting member 44 configured to receive a hearing device comprising a vibrator assembly configured to transmit sound by direct conduction through the bone to the inner ear of the user.

FIG. 6E illustrates a headgear 18 (formed as a cap) provided with an opening 22 for receiving an engagement structure of the mounting member shown in FIG. 6C and FIG. 6F.

FIG. 6F illustrates a close-up view of a mounting member according to an embodiment of the disclosure attached to a structure of a headgear 18 through an opening for receiving an engagement structure 72 of the mounting member. The mounting member comprises a plate member 10 provided with a centrally arranged engagement structure 72 protruding therefrom. The engagement structure 72 is received by an abutment 8 provided at the opposite side of the headgear structure. Accordingly, the headgear structure is sandwiched between the plate member 10 and the back side of the abutment 8.

Figure 7A:
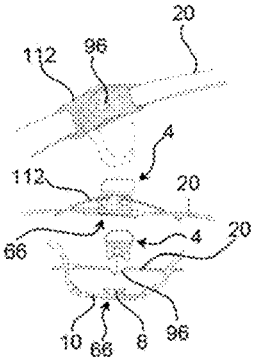
FIG. 7A shows schematic, views of a securing member according to an embodiment of the disclosure attached to a band.

FIG. 7A illustrates schematic views of a securing member 112 according to an embodiment of the disclosure attached to a band 20. The uppermost part of FIG. 7A shows a securing member 112 provided with a hole 96. The securing member 112 comprises a through-going opening that is adapted to receive the band 20 and to providing attachment with the band 20.

The central part of FIG. 7A shows a side view of the securing member 112 shown in the uppermost part of FIG. 7A. It can be seen that a vibrator 4 has been attached to the securing member 112 through the opening 96 provided therein. The opening 96 is configured to flex to allow insertion of the abutment engaging portion of the vibrator through the opening and to abut the periphery of the abutment engaging portion when the vibrator is coupled to the abutment. The skin facing side 66 of a plate member is configured to be brought into contact with the skin of a user.

The lowermost part of FIG. 7A shows a view of the vibrator 4 being attached to an abutment 8 attached to a plate member 10 having a skin facing side 66. The vibrator 4 is being attached to the abutment 8 through an opening 96 provided in the band 20.

Figure 7B:
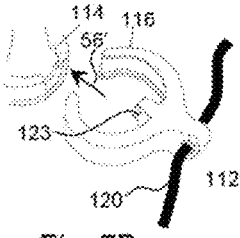
FIG. 7B shows a schematic, perspective view of a connection structure being attached to a securing structure according to an embodiment of the disclosure.

FIG. 7B illustrates a schematic, perspective view of a connection structure 116 being attached to a securing structure 114 according to an embodiment of the disclosure.

The connection structure 116 is formed to engage with the securing structure 114, which represents the coupling between the abutment engaging portion of the vibrator and the abutment. The connection structure 116 comprises an opening for attaching a line 120. The connection structure 116 may further include a gripping element 123 configured to lockingly engage with a corresponding element of the securing structure 114. By moving the connection structure 116 towards the securing structure 114 in the direction indicated with the arrow 56' the connection structure 116 can be attached to the securing structure 114. Hereby, the connection structure 116 can be used to secure the securing structure 114.

Figure 7C:
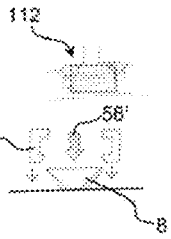
FIG. 7C shows a schematic, side view of a securing member according to an embodiment of the disclosure.

FIG. 7C illustrates a schematic, side view of a securing member 112 according to an embodiment of the disclosure.

The securing member 112 is configured to enclose the coupling between the abutment engaging portion of the vibrator and the abutment. The securing member 112 is configured to flex at a first end when subjected to a force in a direction of the abutment (as shown by 56') and be attached to the abutment 8. The securing member 112 is further configured to flex at a second end, opposite to the first end, and receive the vibrator when the vibrator is moved in a direction of the abutment (as shown by 56'). The vibrator is coupled to the abutment while being enclosed by the securing member 112. It is apparent that the height of the securing member 112 may be customized in accordance to the coupling of the abutment engaging portion and the abutment.

Figure 7D:
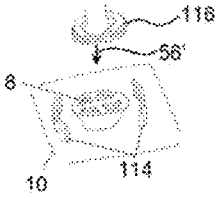
FIG. 7D shows a schematic, perspective view of a connection structure being attached to an abutment protruding from a plate member.

FIG. 7D illustrates a schematic, perspective view of a connection structure 116 (abutment engaging portion of the vibrator) being attached to an abutment 8 protruding from a plate member 10 by moving the connection structure 116 in the direction indicated by the arrow 56'. The connection structure 116 comprises an engaging element configured to engage with the abutment 8 protruding from the plate member 10. The plate member 10 is provided with securing structures 114 formed as arced plate structures protruding from the plate member 10 and at least partially enclosing periphery of the abutment 8. The securing structure is configured to flex when the connection structure 116 is coupled to the abutment 8 such that the securing structure 114 abuts the engagement between the connection structure 116 and abutment 8.

Figure 7E:
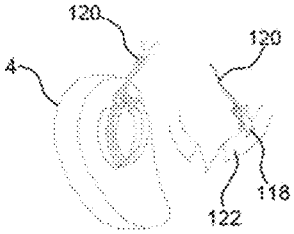
FIG. 7E shows a schematic, perspective view of a vibrator secured to a shirt by means of a clip and a line.

FIG. 7E illustrates a schematic, perspective view of a vibrator 4 secured to a clothing such as a shirt 122 worn by the user by means of a clip 118 and a line 120. The line 120 is secured to protruding elements of the vibrator 4.

Figure 8A:
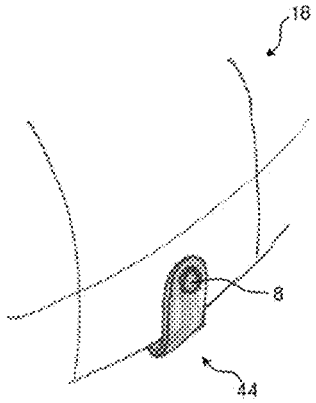
FIG. 8A shows schematic, close-up view of a mounting member according to an embodiment of the disclosure attached to headgear.

FIG. 8A illustrates shows schematic, close-up view of a mounting member 44 according to an embodiment of the disclosure attached to headgear 18. The mounting member 44 is provided with an abutment 8 configured to receive a vibrator assembly (not shown) configured to transmit vibrations to the skin through the bone and then to the inner ear of the user.

Figure 8B:
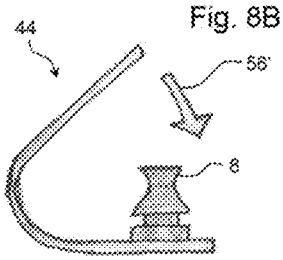
FIG. 8B shows a schematic, close-up, side view of the mounting member shown in FIG. 8A.

FIG. 8B illustrates a schematic, close-up, side view of the mounting member 44 shown in FIG. 8A. The mounting member 44 comprises an abutment 8 and a foldable flat portion provided with an opening (not shown, but visible in FIG. 8D) adapted to receive the abutment 8 when the foldable flat portion is moved in a direction towards the abutment, indicated by the arrow 56'.

Figure 8C:
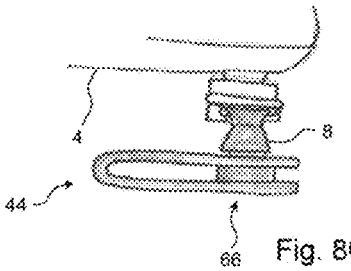
FIG. 8C shows a schematic, close-up, side view of the mounting member shown in FIG. 8B attached to a vibrator.

FIG. 8C illustrates a schematic, close-up, side view of the mounting member 44 shown in FIG. 8B attached to a vibrator 4. It can be seen that the vibrator 4 is attached to the abutment 8 of the mounting member 44.

Figure 8D:
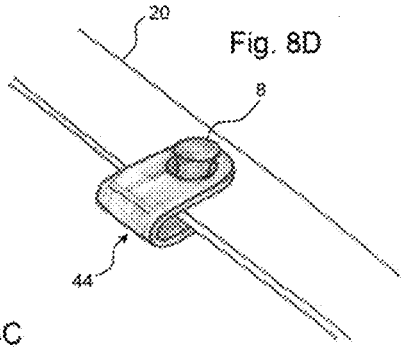
FIG. 8D shows a schematic, close-up, side view of the mounting member shown in FIG. 8B attached to a band.

FIG. 8D illustrates a schematic, close-up, side view of the mounting member 44 shown in FIG. 8B attached to a band 20. The opening of the mounting member 44 is aligned with a hole provided at the band 20 and the opening is adapted to receive the abutment 8, (as shown), which is configured to pass through the hole provided at the band.

FIG. 9A illustrates a schematic, side view of a user wearing a plate member 10 according to a mounting assembly of an embodiment of the disclosure attached to band 20. The band 20 is attached to the skull 14 of the user. The band 20 comprises a portion 82 such as a rear portion that may be made in an elastic material. The plate member 10 is provided with an abutment 8 protruding from the central portion of the plate member 10.

The rear portion is defined by section that is configured to be positioned behind the ears of the user.

FIG. 9B illustrates a schematic, rear view of a user wearing a band with the plate member 10 shown in FIG. 9A. The band is attached to the skull 14 of the user and comprises rear portion 82.

FIG. 9C illustrates schematic, close-up views of a plate member 10 and a band 20 according to a mounting assembly of an embodiment of the disclosure. The plate member 10 comprises an abutment 8 protruding, usually from the central portion, outward from the plate member. The plate member 10 is provided with a through-going opening configured to receive the band 20. The through-going hole is configured to allow sliding the plate member along a length of the band 20 as indicated by the arrow 56. The skilled person would appreciated that the plate member configuration is not limited to the band illustrated in FIGS. 9A and 9B.

For example, the band may include a band that is made of an elastic material throughout the length of the band.

It can be seen that the band 20 may be length adjusted by using a pair of scissors to cut the band 20 along a cutting line 24. The band 20 comprises a band portion 62 inserted into a surrounding sleeve portion 64.

Figures 10A, 10B, 10C, 10D, 10E, 10F, 10G, 10H:
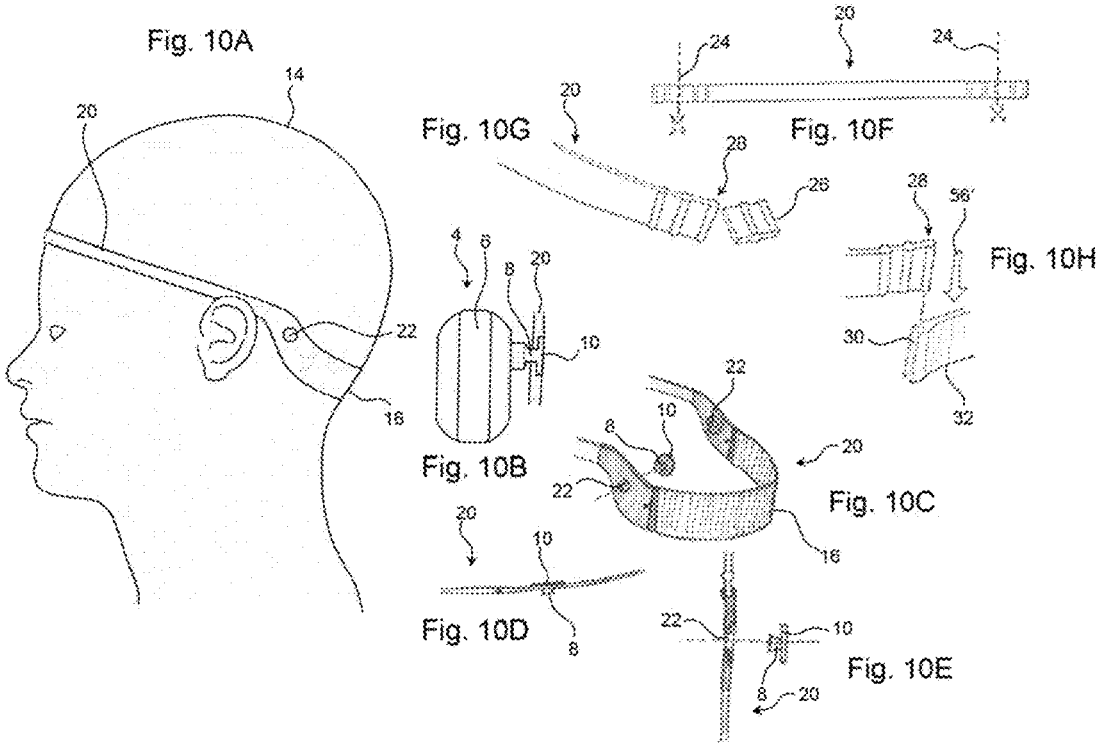
FIG. 10A shows a schematic, side view of a user wearing a band provided with an elastic portion and a hole for attaching a mounting assembly of an embodiment of the disclosure.
FIG. 10B shows a schematic, side view of a vibrator attached to a band by means of a mounting assembly of an embodiment of the disclosure.
FIG. 10C shows a schematic, rear view of the band shown in FIG. 10A.
FIG. 10D shows a schematic, side view of a band and the mounting assembly of an embodiment of the disclosure.
FIG. 10E shows a schematic, side view of a band and according to a mounting assembly of the disclosure in a configuration in which the plate member is inserted into a hole.
FIG. 10F shows a schematic view of a band being cut.
FIG. 10G shows a schematic view of an end portion of the band shown in FIG. 10F.
FIG. 10H shows a schematic view of the two end portions of the band shown in FIG. 10G being assembled.

FIG. 10A illustrates a schematic, side view of a user wearing a band 20 provided with an a portion 16 such as an elastic portion and a hole 22 for attaching a mounting assembly of an embodiment of the disclosure. The band 20 may be worn over head 14 of the user.

FIG. 10B illustrates a schematic, side view of a vibrator 4 attached to a band 20 by means of a mounting assembly of an embodiment of the disclosure. The speech processor housing comprises a vibrator 6 and is attached to an abutment 8 attached to a plate member 10 attached to the band 20 through a hole provided therein (see FIG. 10 A).

FIG. 10C illustrates a schematic, rear view of the band 20 shown in FIG. 10A. The band 20 comprises a portion 16 such as an elastic portion 16 adapted to be arranged preferably at the rear portion of the head of the user. The band 20 is provided with two holes 22 configured to receive an abutment 8 of a plate member 10. This allows for providing a bilateral bone conduction solution. Hereby, it is possible to attach a speech processor housing 4 comprises a vibrator 6 to the abutment 8 as shown in FIG. 10B, individually at the two holes.

The rear portion is defined by section that is configured to be positioned behind the ears of the user.

FIG. 10D illustrates a schematic, side view of a band 20 and the mounting assembly of an embodiment of the disclosure. It can be seen that the abutment 8 of the plate member protrudes from the plate member 10 and from the band 20. Accordingly, the abutment is configured to receive a speech processor 4 comprising a vibrator 6 to the abutment 8 as shown in FIG. 10B.

FIG. 10E illustrates a schematic, side view of a band 20 and according to a mounting assembly of the disclosure in a configuration in which the abutment 8 is inserted in the hole 22 such that the flat portion, configured to abut the skin, is on one side of the band and the abutment to which the vibrator is couplable is one the other side of the band.

FIG. 10F illustrates a schematic view of a band 20 being cut. Cutting lines 24 may be indicated at least at one end of the band and preferably at both ends of the band 20. By cutting the band 20 it is possible to adjust the length of the band 20 in order to make it fit the size of a skull. The end portions of the band 20 are provided with structures adapted to engage with corresponding structures (see FIG. 10H).

FIG. 10G illustrates a schematic view of an end portion of the band 20 shown in FIG. 10F. The cut away portion 26 is discarded and the band 20 with main portion comprising the engagement members 28 at two ends of the bands are adapted to engage with one another to form a closed loop.

FIG. 10H illustrates a schematic view of the two end portions of the band 20 shown in FIG. 10F (after cutaway portion is discarded) being assembled. The engagement members 28 (at one end) fit the receiving portion 30 of the engagement member 32 of the other end. The mechanism of the couplable engagement members may be selected from hook-and-loop fasteners, zippers, button-loop arrangement, a male-female configuration such as illustrated in the figure where a male member at one end is slidably positionable in a slot arranged at the second end when the male member is moved along direction of width of the band. Other generally known mechanisms may also be implemented. Hereby, it is possible to attach the two ends of the band 20 to each other by means of a simple geometric engagement.

FIG. 11A illustrates a schematic, side view of a hearing device 2 attached to a band 20 fixed to the skull 14 of a user by means of a mounting assembly of an embodiment according to the disclosure. The band 20 comprises a portion such as a rear portion to which the hearing device 2 is attached. The rear portion is defined by section that is configured to be positioned behind the ears of the user. However, the band may be worn such that the portion is a front portion, i.e. in the foreheard region (left side of FIG. 11D).

FIG. 11B illustrates a schematic, side view of a vibrator 4 attached to a band 20 by means of a mounting assembly 44 (described further in relation to FIG. 11C) of an embodiment of the disclosure. The vibrator 4 is attached to an abutment 8 protruding from a plate member of the mounting assembly 44.

FIG. 11C illustrates a schematic, close-up, perspective view of a band 20 provided with the mounting assembly 44 shown in FIG. 11B. The band 20 comprises a mounting portion 38 comprising a mounting aperture 36. The mounting assembly 44 comprises a sliding mounting assembly 34 that is configured to be slidably positioned at the mounting aperture. The slideable positioning is configured to allow the sliding mounting assembly 34 to move along the length of the mounting portion 38 of the band 20 by pushing it in the direction along length of the mounting portion (as shown by direction 56).

The sliding mounting assembly 34 may include a two pairs of parallel tunnels at opposite end of the mounting assembly 34, each tunnel being adapted to receive a parallel spaced apart sections, defined by the mounting aperture 36, of the band. The sliding mounting assembly 34 is configured to move along the band within length of the mounting portion 38 while the parallel spaced apart sections positioned within each tunnel.

FIG. 11D shows a user wearing the band shown in FIG. 11A in two different configurations. The left figure shows the band being worn in a front configuration with the mounting assembly slidably positionable over forehead of the user. The right figure shows the band being worn in a rear configuration with the mounting assembly slidably positionable behind the ears of the user.

FIG. 11E illustrates a schematic, side view of a mounting assembly 44 attached to a string/chain 20' fixed to the skull 14 of a user.

FIG. 11F illustrates a schematic, close-up, perspective view of the mounting assembly 44 shown in FIG. 11E. The mounting assembly 44 comprises an abutment 8 protruding therefrom. A first attachment member 40' and a second attachment member 42' are attached to the side portions of the mounting assembly 44. The mounting assembly 44 comprising a plate member adapted to be brought into skin contact. The string 20' comprises a first end provided with an band attachment member 40 configured to be attached to the first attachment member 40' and a second end provided with a band attachment member 42 configured to be attached to the second attachment member 42'. Each end portions of the string 20' is provided with length adjusting members 46, 46' adapted to adjust length of the band under an application of a pulling force. The coupling between the attachment members may utilize a loop locking such as the first attachment member 40' and the second attachment member 42' individually include a openable loops that are adapted to receive the attachment members 40, 42, defined by a loop of the band. The openable loops are adapted to be locked in position to form a closed loop.

FIG. 11G illustrates a schematic, close-up, perspective view of the mounting assembly 44 shown in FIG. 11F attached to the string/chain 20'. The length adjusting members 46, 46' is configured to adjust length of the string 20' by application of a pulling force. The length adjusting members 46, 46' is configured such that under influence of the pulling force, length of loop of the band is changed and thereby the length of the string 20' is adjusted.

FIG. 12A illustrates a schematic, close-up view of a bracket mount 50 of a mounting assembly according to an embodiment of the disclosure. The bracket mount 50 comprises an abutment 8, generally centrally arranged, protruding from the remaining part of the bracket mount 50. The bracket mount 50 comprises a through-going opening configured to receive a band 20. The bracket mount 50 is configured to slide along the length of the band.

FIG. 12B illustrates a schematic, side view of a vibrator 6 attached to a band 20 positioned over a user's head 14 by means of a mounting assembly of an embodiment according to the disclosure. The band 20 is provided with an attachment structure 48 that can be seen in a close-up view in FIG. 12C. In this embodiment and also in earlier disclosed embodiments, the band may providing an attaching means that allow for attaching a decorative accessory to the band for example a bow as shown in the figure.

FIG. 12C illustrates a schematic, side view of the attachment structure 48 according to an embodiment of the disclosure. The attachment structure 48 comprises a first attachment member 52 and a second attachment member 52' preferably detachably attached to each other. The end portions 54, 54' of the band 20 attaches to the first attachment member 52 and the second attachment member 52' respectively. The attachment structure 48 can be moved by pulling the end portion 54 of the band in the direction of length of the band as indicated with the arrow 56.

FIG. 12D illustrates a schematic view of a bracket mount 50 of a mounting assembly according to an embodiment of the disclosure. The bracket mount 50 comprises an abutment 8 protruding centrally from the bracket mount 50. The bracket mount 50 moreover comprises at least one button such as a first button 58 and a second button 58'. The at least one button, under non-application of an inward force, is configured to position the bracket in a locked configuration such as through friction fit with the band. The button is configured bring the bracket mount 50 into an unlocked configuration with the band when an inward force on the at least one button is applied. In the unlocked configuration, the bracket is adapted to move freely along length of the band. FIG. 12E illustrates a schematic view of the bracket mount 50 shown in FIG. 12D attached to a band 20. The band 20 is attached to the user's head 14 and the bracket mount 50 is slidably attached to the band 20. The bracket mount 50 can be moved along the length of the band 20 from the first position I to a second position II indicated in FIG. 12E. The activation buttons (58, 58' in FIG. 12D) may be used to bring the bracket mount 50 into a configuration in which it can be moved along the length of the band 20. The skilled person would appreciate that the more than one bracket for positioning more than one vibrator may also be used for bilateral type of bone conduction solutions.

Figure 13A:
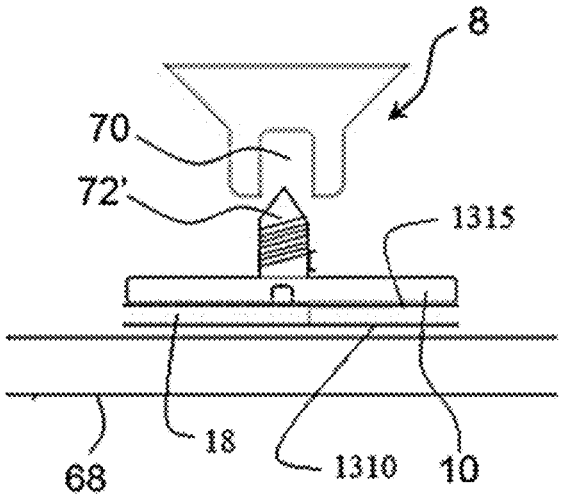
FIG. 13A shows a schematic view of a mounting assembly where the mounting structure includes a double sided adhesive tape according to an embodiment of the disclosure.

FIG. 13A shows a schematic view of a mounting assembly where the mounting structure includes a double sided adhesive tape according to an embodiment of the disclosure. The mounting structure 18 includes a double-sided adhesive tape. The double sided adhesive tape includes a first side 1315 configured to be attached to skin facing side of the plate member 10 and a second side 1310 configured to be attached to the skin 68 over the skull.

The abutment 8 is provided with a bore 70 comprising cavities for receiving the engagement structure 72' of the plate member 10. Accordingly, the plate member 10 can be arranged on the head of a user in a manner in which the plate member 10 is brought into contact with the skin 68. When a vibrator assembly of a bone conduction hearing device (not shown) is attached to the abutment 8, the vibrator assembly can transmit vibrations through user skin through bone such as skull bone to the inner ear via the abutment 8 and the plate member 10.

Figure 13B:
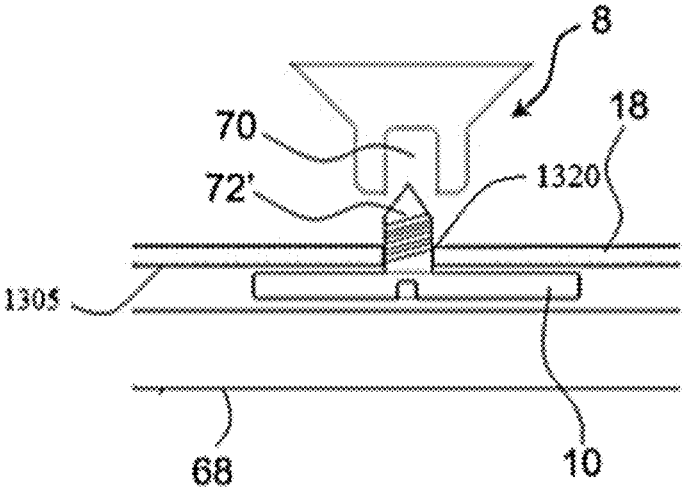
FIG. 13B shows a schematic view of a mounting assembly where the mounting structure includes a single sided adhesive tape according to an embodiment of the disclosure.

FIG. 13B illustrates a schematic view of a mounting assembly where the mounting structure includes a single sided adhesive tape according to an embodiment of the disclosure. The mounting structure 18 includes a single-sided adhesive tape comprising a hole 1320. The hole 1320 is configured to allow the engagement structure 72' to extend through the hole. The engagement structure 72' is adapted to couple with an attachment element such as an abutment 8 that is configured to be positioned on the other side of the single sided adhesive tape. The skin facing side 1305 of the single sided tape includes an adhesive material configured to attach to the skin over skull. The single sided tape 18 typically extends beyond edge of the plate member and is flexible enough so that the tape can be bent around edge of the plate member and attach to the skin surface.

Referring to different embodiments illustrated in any of the FIGS. 2F, 3D, 4A, 4C, 4D, and 11A, a bone conduction hearing aid assembly is disclosed. The bone conduction hearing aid assembly includes a bone conduction hearing aid (2), a mounting structure (18, 20) configured to be worn around a user's head; a mounting assembly according to any of the features described previously in the disclosure. The mounting assembly is configured to be attached to the mounting structure and the bone conduction hearing aid (2) is configured to be removably attached to the mounting assembly.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening elements may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

The invention claimed is:

1. A mounting assembly for arranging a bone conducting hearing device on a skin surface over the skull of a user, the mounting assembly comprising:

a bracket member comprising a receiving structure and an insert structure, the receiving structure being configured to receive the insert structure, the receiving structure including an attachment element configured to be attached to a corresponding vibrator attachment element of a vibrator assembly, the attachment element and the vibrator attachment element being adapted to operationally couple with each other, and a plate member configured to contact the skin surface over the skull; and a removably arranged mounting structure arranged outside the skull for attaching the bracket member to the skin surface over the skull, wherein a portion of the mounting structure is configured to be sandwiched between elements of the bracket member when the insert structure is received in the receiving structure.

2. A mounting assembly according to claim 1, wherein the plate member comprises an engagement structure and the attachment element comprises an abutment comprising a second receiving structure configured to permanently or detachably lock with the engagement structure.

3. A mounting assembly according to claim 1, wherein the plate member is configured to be positioned at the skin facing side of the bracket member and the attachment element is configured to be positioned at the other side of the bracket member, wherein the attachment element engagement structure is configured to extend through an opening in the mounting structure.

4. A mounting assembly according to claim 2, wherein the insert structure that is bendable and configured to form an edge along a bend, the insert structure comprises a hole through which the abutment is configured to extend when the insert structure is bent to form the edge.

5. A mounting assembly according to claim 1, wherein the insert structure comprises one or more protrusions and that the receiving structure comprises one or more corresponding openings configured to receive the protrusion(s), wherein the insert structure is configured to be attached to the mounting structure.

6. A mounting assembly according to claim 1, wherein the insert structure and/or the receiving structure comprises a first portion configured to be arranged over the mounting structure and a second portion configured to be arranged under the mounting structure.

7. A mounting assembly according to claim 1, wherein the mounting assembly comprises one or more length adjust member adapted to adjust the length of the mounting structure and/or the position of the mounting assembly with respect to the bracket member.

8. A mounting assembly according to claim 1, wherein the bracket member is configured to be slidably attached to the mounting structure.

9. A mounting assembly according to claim 1, wherein the mounting assembly comprises an element configured to allow the bracket member to be displaced relative to the mounting structure.

10. A mounting assembly according to claim 1, wherein the mounting assembly comprises a locking element configured to attach the vibrator assembly directly or indirectly to a connection structure or a piece of cloth.

11. A bone conduction hearing aid assembly comprising a bone conduction hearing aid, a mounting structure configured to be worn around a user's head;

a mounting assembly according to claim 1, the bracket member being configured to be attached to the mounting structure and the bone conduction hearing aid is configured to be removably attached to the mounting assembly.

12. A mounting assembly according to claim 2, wherein the plate member is configured to be positioned at the skin facing side of the bracket member and the abutment is configured to be positioned at the other side of the bracket member, wherein the engagement structure is configured to extend through an opening in the mounting structure.

* * * * *